US006145155A

United States Patent [19]

James et al.

[11] Patent Number: 6,145,155

[45] Date of Patent: Nov. 14, 2000

[54] DOUBLE SIDED CLEANING PAD MITT WITH SEALED PACKAGE

[76] Inventors: Glenn P. James; Teresa James, both of 353 Columbus Ave., North Babylon, N.Y. 11703

[21] Appl. No.: 09/228,264

[22] Filed: Jan. 11, 1999

[51] Int. Cl.[7] ..... A47L 13/19

[52] U.S. Cl. ..... 15/227; 15/104.94; 15/118

[58] Field of Search ..... 15/104.94, 118, 15/227

[56] References Cited

U.S. PATENT DOCUMENTS

| | | | |
|---|---|---|---|
| Re. 35,814 | 6/1998 | Olson . | |
| D. 385,660 | 10/1997 | Conterelli . | |
| 3,329,985 | 7/1967 | Glowacki | 15/227 |
| 3,608,708 | 9/1971 | Storandt | 15/104.94 |
| 3,806,260 | 4/1974 | Miller | 15/104.94 |
| 4,071,921 | 2/1978 | Jury . | |
| 4,347,931 | 9/1982 | Ginger et al. . | |
| 4,510,640 | 4/1985 | Omori | 15/227 |
| 4,601,081 | 7/1986 | Sutton et al. . | |
| 4,610,357 | 9/1986 | Nakamura . | |
| 4,645,251 | 2/1987 | Jacobs . | |
| 4,656,068 | 4/1987 | Raines . | |
| 4,670,930 | 6/1987 | Lu . | |
| 4,788,733 | 12/1988 | Lerner . | |
| 4,902,283 | 2/1990 | Rojko et al. . | |
| 4,953,250 | 9/1990 | Brown . | |
| 4,959,881 | 10/1990 | Murray | 15/104.94 |
| 4,964,188 | 10/1990 | Olson . | |
| 5,111,934 | 5/1992 | Morin . | |
| 5,196,224 | 3/1993 | Beck . | |
| 5,473,789 | 12/1995 | Oster | 15/104.94 |
| 5,560,067 | 10/1996 | Brook | 15/104.94 |
| 5,607,081 | 3/1997 | Levy . | |
| 5,702,992 | 12/1997 | Martin et al. . | |
| 5,715,841 | 2/1998 | Utecht . | |
| 5,732,716 | 3/1998 | Utecht . | |
| 5,833,061 | 11/1998 | Storandt . | |

*Primary Examiner*—Terrence R. Till
*Attorney, Agent, or Firm*—Dilworth & Barrese

[57] ABSTRACT

A flexible cleaning and drying mitt has a pouch compartment formed therein which is proportioned for receiving the hand of a user. The mitt has a pair of removable cover faces and a flat moisture-proof perimeter, which perimeter extends outward from a pair of work surfaces and in coextensive contact with each respective work surface of the pair of work surfaces. The pair of work surfaces includes a wetting face and a drying face, with respective wetting and drying pads thereon. The wetting pad is pre-soaked with a cleaning fluid for wipe-on application to a surface to be cleaned. The drying face has a drying pad mounted on an opposite side of the mitt from the wetting pad. The covers are releasably secured to the pouch compartment of the mitt. The pouch compartment includes a pair of separate moisture-sealed compartments, which are arranged to cooperate with the respective wetting and drying faces to form separate respective moisture proof enclosures about the respective wetting and drying pads of the mitt.

26 Claims, 7 Drawing Sheets

DOUBLE SIDED CLEANING PAD MITT WITH SEALED PACKAGE

FIELD OF THE INVENTION

The present invention relates to double-sided cleaning mitts having both a cleaning surface and an absorbent drying surface.

BACKGROUND OF THE INVENTION

Various attempts have been made to provide cleaning pads in the form of mitts which can be worn upon the hand.

For example, U.S. Pat. No. 4,959,881 of Murray describes a cleaning mitt having a hand compartment to accommodate the hand of the user through an opening. The mitt includes a cleaning pad mounted on the front face of the mitt and a peel off removable sealing cover over the cleaning pad, and an outer pocket which accommodates the pad sealing cover after removal of the cover from its position covering the cleaning pad. However, Murray '881 does not also have an absorbent, drying pad.

Furthermore, U.S. Pat. No. 5,473,789 of Oster describes a disposable pad for cleaning a toilet seat. The cleaning pad has a wet cleaning agent absorbed therein. A flap opens to expose the cleaning pad. When the flap is folded back after use, the now exposed folded surface can be used as a drying surface. However, the user's hands must manually grasp a pull-tab, which may be contaminated by the surface being cleaned. In addition, the folded flap does not fully cover the drying surface of the mitt, so there is an exposed portion of the contaminated surface which is not covered by the flap, making for a contaminated and unsightly drying surface.

Other related patents include U.S. Pat. No. 4,601,081 of Sutton, which describes a cleaning pad with a handle rod to hold during use. While Sutton '081 includes a pad, which is wet on one side and dry on the other side, it does not provide a mitt for the user's hand to be inserted into.

U.S. Pat. No. 5,607,081 of Levy discloses a disposable wet cleaning pad within a sealed package, wherein a dry absorbent pad is also included. However, Levy '081 does not describe a cleaning mitt for insertion of the hand of the user therein.

U.S. Pat. No. 4,610,357 of Nakamura describes a sealed, tear-openable package with a wet cleaning pad and a dry absorbent pad. However, Nakamura '357 does not also function as a mitt.

Furthermore, U.S. Pat. No. 4,788,733 of Lerner discloses a cleaning mitt with a wet cleaning surface, but not with a drying surface.

U.S. Pat. No. 4,701,921 of Jury discloses a grease-absorbing mitt without an opposite drying surface.

U.S. Pat. No. 5,111,934 of Morin describes a sealed package with two airtight compartments; one with a sponge moistened with cleaning fluid and a separate drying pad. However, Morin '934 does not describe a mitt.

Moreover, U.S. Pat. No. 4,656,068 of Raines discloses a cylindrical sealed meat package with a tear-off cover.

However, none of the aforesaid patents provide a convenient cleaning mitt having a wet cleaning surface on one side and a dry absorbent drying surface on the other side, wherein the wet and dry surfaces are isolated from each other by a sealed pouch enclosing the mitt.

OBJECTS OF THE INVENTION

It is therefore an object of the present invention to provide a convenient cleaning mitt having a wet cleaning surface on one side and a dry absorbent drying surface on the other side, wherein the wet and dry surfaces are isolated from each other by a sealed pouch enclosing the mitt.

It is also an object of the present invention to provide a disposable cleaning mitt and packaging system.

It is also an object of the present invention to provide a flexible cleaning mitt having a pouch compartment formed therein which is proportioned for receiving the hand of a user.

It is also an object of the present invention to provide a cleaning mitt having a pull-ribbon extending therewithin for finger-grasp pulling of the cleaning mitt inside out.

It is also an object of the present invention to provide a cleaning mitt with a flat moisture-proof perimeter.

It is a further object of the present invention to provide a cleaning mitt which is flexible yet strong, and impervious to liquids, gases and caustic cleaning solutions.

It is yet another object of the present invention to provide a cleaning mitt, which has structural integrity when a peel-off cover is torn off to expose the pouch portion of the cleaning mitt.

It is yet another object of the present invention to provide a cleaning mitt with a pair of faces, including a wetting face and a drying face.

It is also an object of the present invention to provide a cleaning mitt with a wetting pad being pre-soaked with a cleaning fluid for wipe-on application to a surface to be cleaned, together with a drying face having a drying pad mounted thereon.

It is also an object of the present invention to provide leak-proof thermoplastic seals for a pouch enclosing a combination cleaning and drying mitt.

It is also an object of the present invention to provide a sealed pouch for a cleaning mitt wherein the pouch is substantially flat and moisture-proof.

It is also an object of the present invention to provide a sealed cover for a cleaning mitt.

It is also an object of the present invention to provide a convenient, disposable cleaning mitt which also functions as a drying mitt when reversed in position upon the hand of a user.

It is yet another object of the present invention to improve over the disadvantages of the prior art.

SUMMARY OF THE INVENTION

In keeping with these objects and others, which may become apparent, the present invention includes a disposable, flexible cleaning and drying mitt that fits over the user's hand. The mitt has one or more covers and it has respective pads attached to each of the two outer surfaces of an inner pouch portion of the mitt.

One pad is saturated with a variety of possible solutions for window cleaning, polishing, dusting, buffing, skin applications, etc.

The other pad is kept dry for drying, wiping, or absorbing the excess solution after completion of the application.

The two pads are covered by the covers, such as peel-off plastic covers, that contain the cleaning solution within the mitt and protect the two pads until use.

There is an optional plastic film ribbon formed into the fingertip area seal of the mitt in the form of a pull-ring that facilitates turning the mitt inside out after use.

One of the advantages of the present invention is that it is a two-sided cleaning mitt for a portable kit for cleaning a hard-to-reach surface, such as the inside windshield of an automobile. The cleaning and drying mitt also cleans the inside windows of an automobile and is disposable, and easily portable. It may be packaged in a multi-pack which is flexible enough to fit into a glove box or pocket, and which is temperature-stable.

The appropriate materials for the cleaning and drying mitt include plastic films that are:

1. flexible and strong enough to be used as the structural components of a cleaning mitt;
2. impervious to liquids, gases, and a list of possible cleaning and caustic solutions;
3. able to be economically bonded together; and,
4. most importantly: able to be peeled apart without ripping, distorting, or disrupting the integrity or functionality of the mitt.

The preferred embodiment, at present, is to fashion the hollow pouch portion of the cleaning and drying mitt itself from a thermoplastic material, such as a polymer, excluding a non-thermoplastic polyester. Such thermoplastic materials include heat sealable polymers, such as, for example, polypropylene or polyethylene, among others. These materials bind properly, but non thermosplastic polyesters do not.

Preferably, the pouch portion of the mitt has two sides, where each side is about 5 mil in thickness. Although size may be varied to accommodate different sizes of human hands, the size is preferably 7 inches wide by 9 inches long.

The peel-away covers that enclose the hollow pouch portion, which contains the cleaning solution-saturated pad and the dry drying pad, are preferably made using a 1.8–2.0 mil co-extrusion of aluminized MYLAR, polyester film-polyethylene laminate film. The lower polyethylene layer of each polyester film/polyethylene laminate cover is thermally bonded to the thermoplastic polymer, such as polyethylene, layer of the mitt. This creates a bond that is flexible, strong and impervious to cleaning solutions. The thinness (approx. 1 mil) of the polyethylene layer of each cover allows for each polyester film/polyethylene laminate cover to be peeled away without ripping and damaging the thicker polyethylene film of the mitt itself.

The cleaning solution in the cleaning pad is a strong cleaning solution, such as Prestone's Windshield De-Icer Washer Fluid.

Existing cleaning mitts have no solution for adhering pad covers to the mitt. This is a major obstacle to the practical performance of the cleaning and drying mitt. The selection of the plastic film covers to be thermally bonded is a big part of the construction of the cleaning and drying mitt of the present invention.

DESCRIPTION OF THE DRAWINGS

The present invention can best be described in conjunction with the accompanying drawings, wherein dimensions are exaggerated for illustrative purposes, in which.

DETAILED DESCRIPTION OF THE PREFERRED EMBODIMENTS

Figure 1:
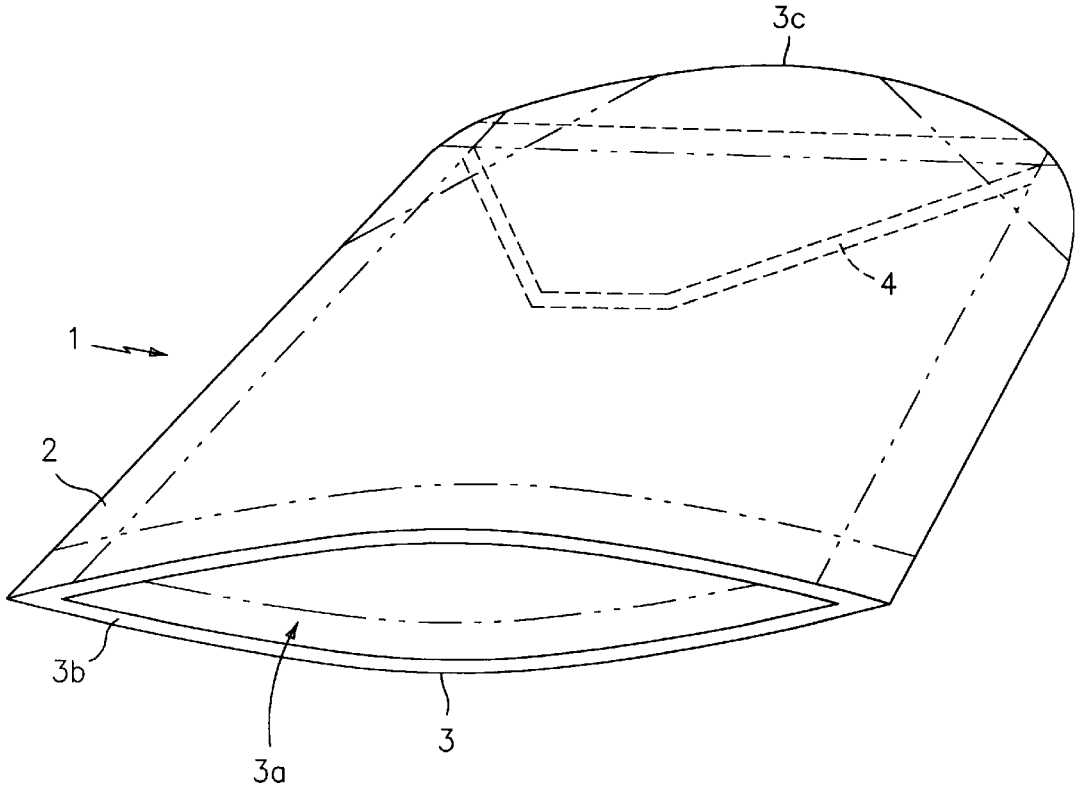
FIG. 1 is a perspective view of an open cleaning/drying mitt with a sealed pouch, as in the present invention.
Figure 2:
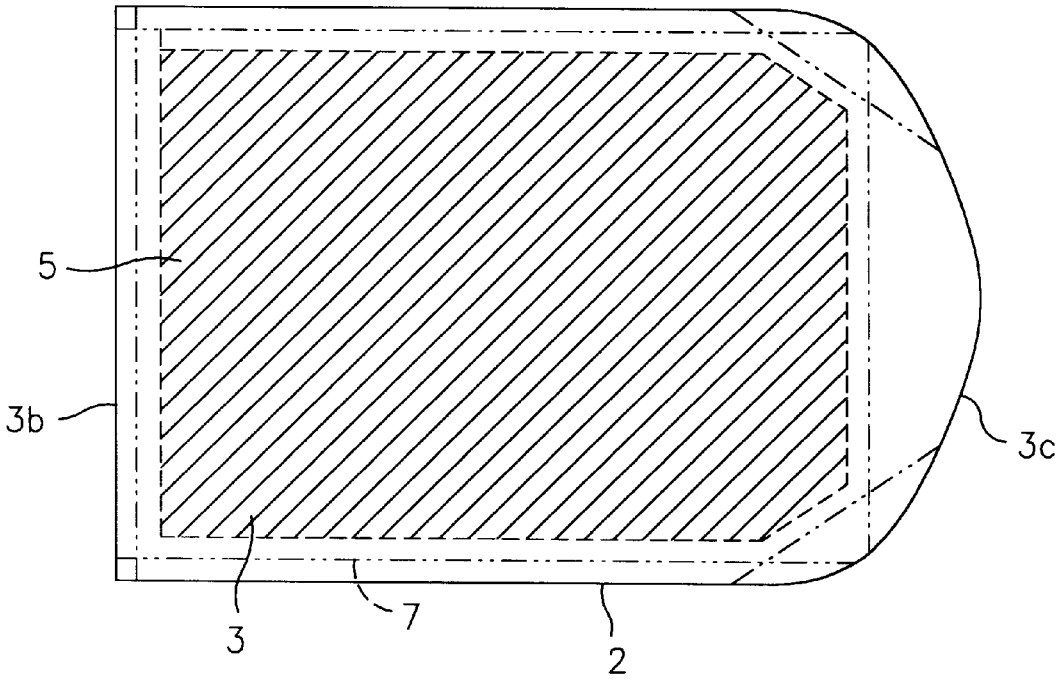
FIG. 2 is a top plan view thereof.
Figure 3:
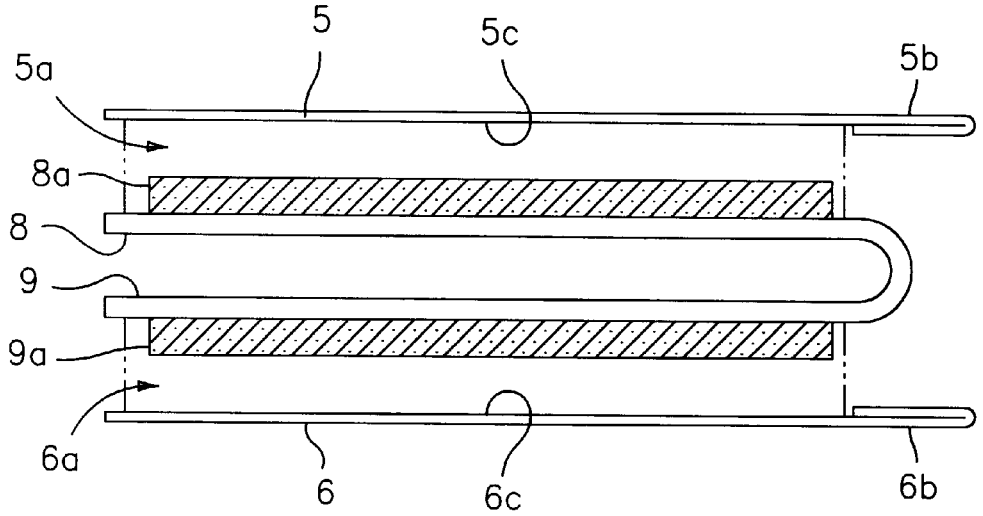
FIG. 3 is an exploded side elevational view thereof.
Figure 4:
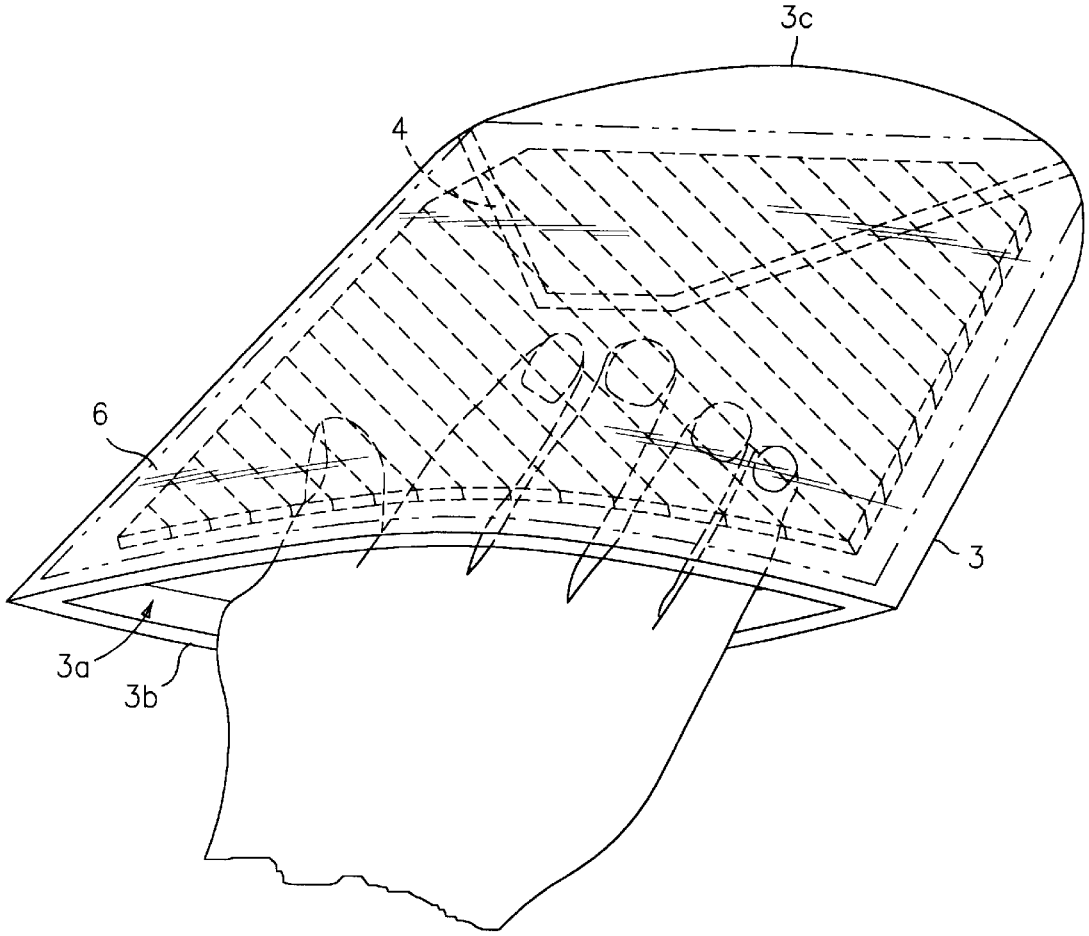
FIG. 4 is a perspective view, showing the insertion of a hand into the cleaning and drying mitt prior to use, wherein the portions of the user's hand shown in dotted lines are portrayed for environmental purposes only.
Figure 5:
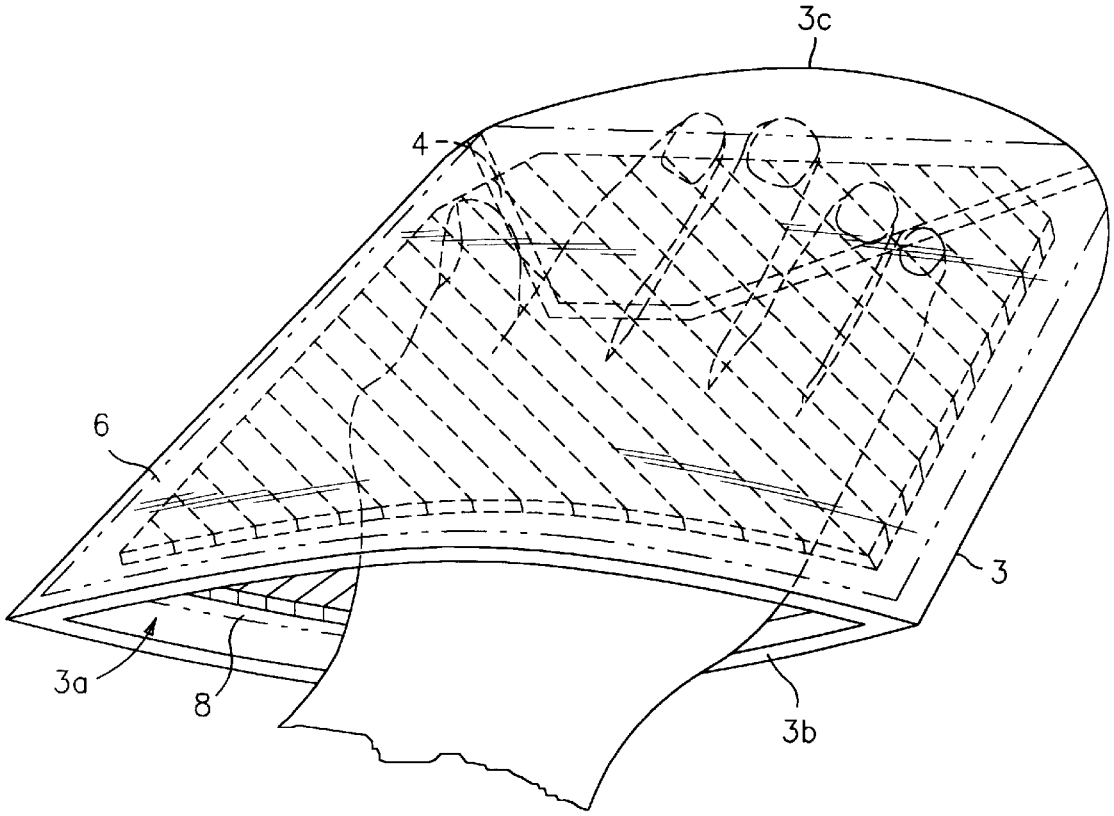
FIG. 5 is a perspective view showing the cleaning and drying mitt ready for use in the cleaning mode, wherein the portions of the user's hand shown in dotted lines are portrayed for environmental purposes only.
Figure 6:
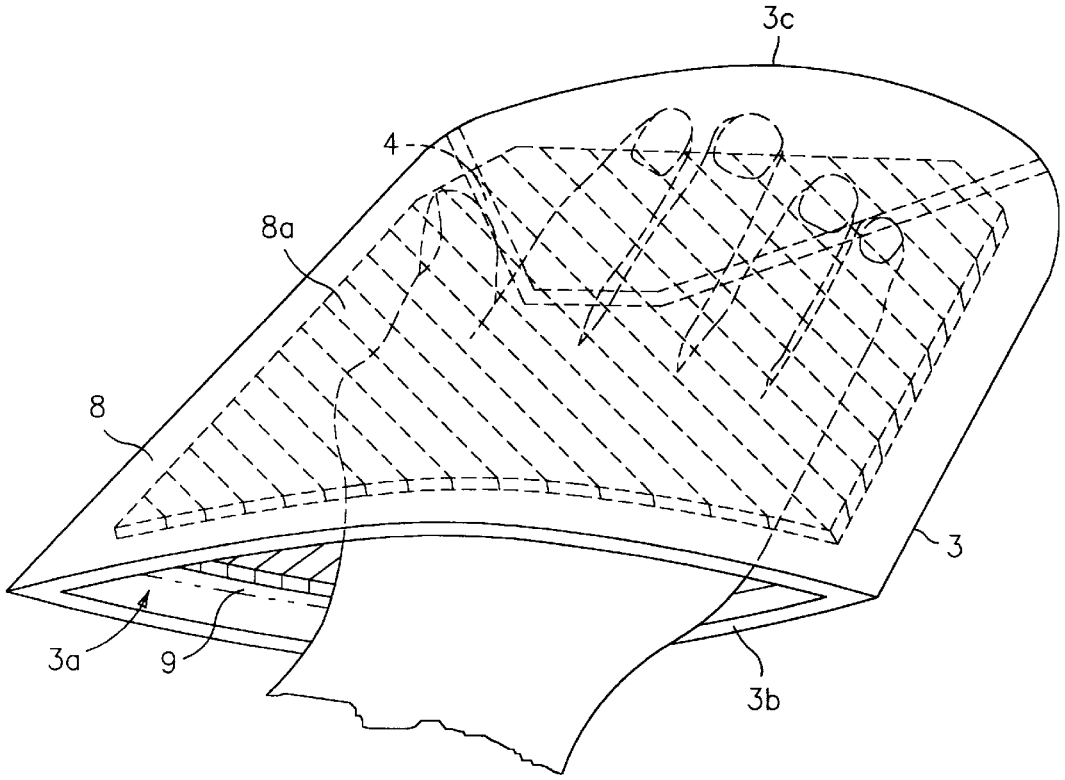
FIG. 6 is a perspective view showing the cleaning and drying mitt ready for use in the inverted drying mode, wherein the portions of the user's hand shown in dotted lines are portrayed for environmental purposes only.
Figure 7:
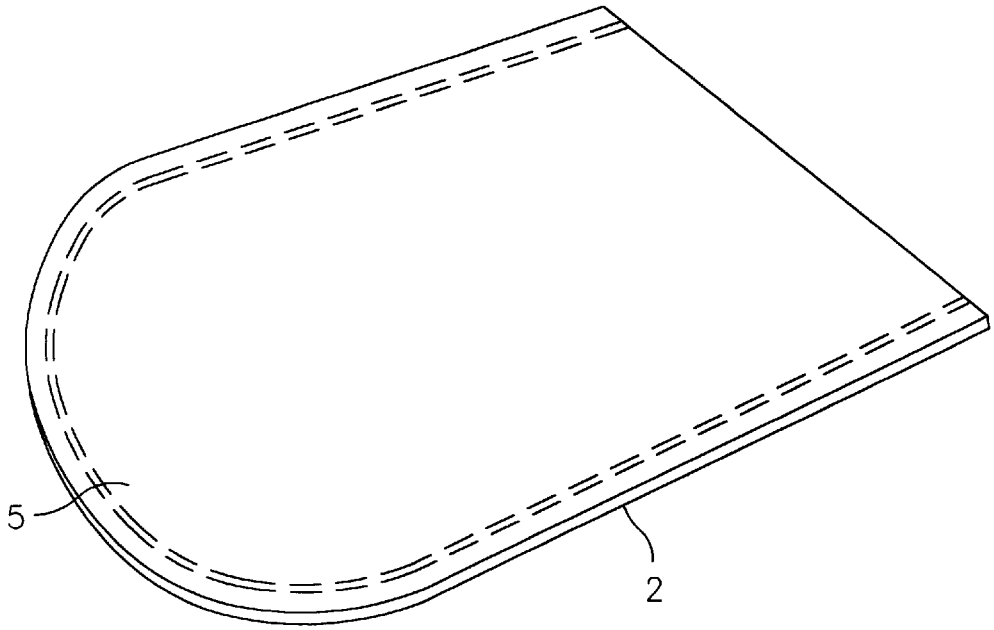
FIG. 7 is a perspective view of the cleaning and drying mitt prior to use.
Figure 7A:
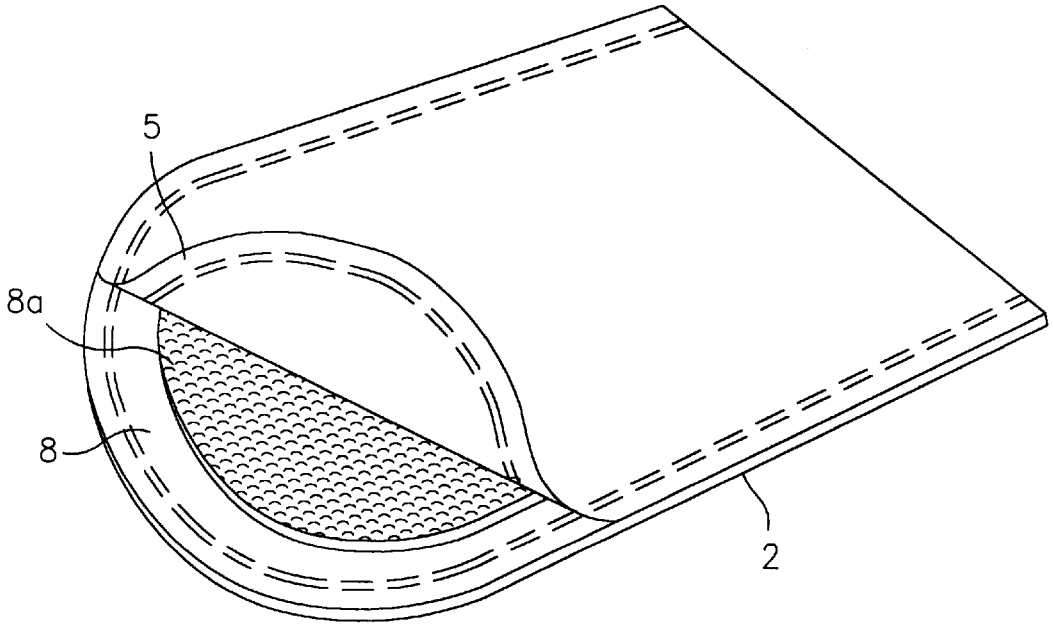
FIG. 7A is a perspective view showing the removal of a peel-away outer layer from cleaning and drying mitt in use.
Figure 8:
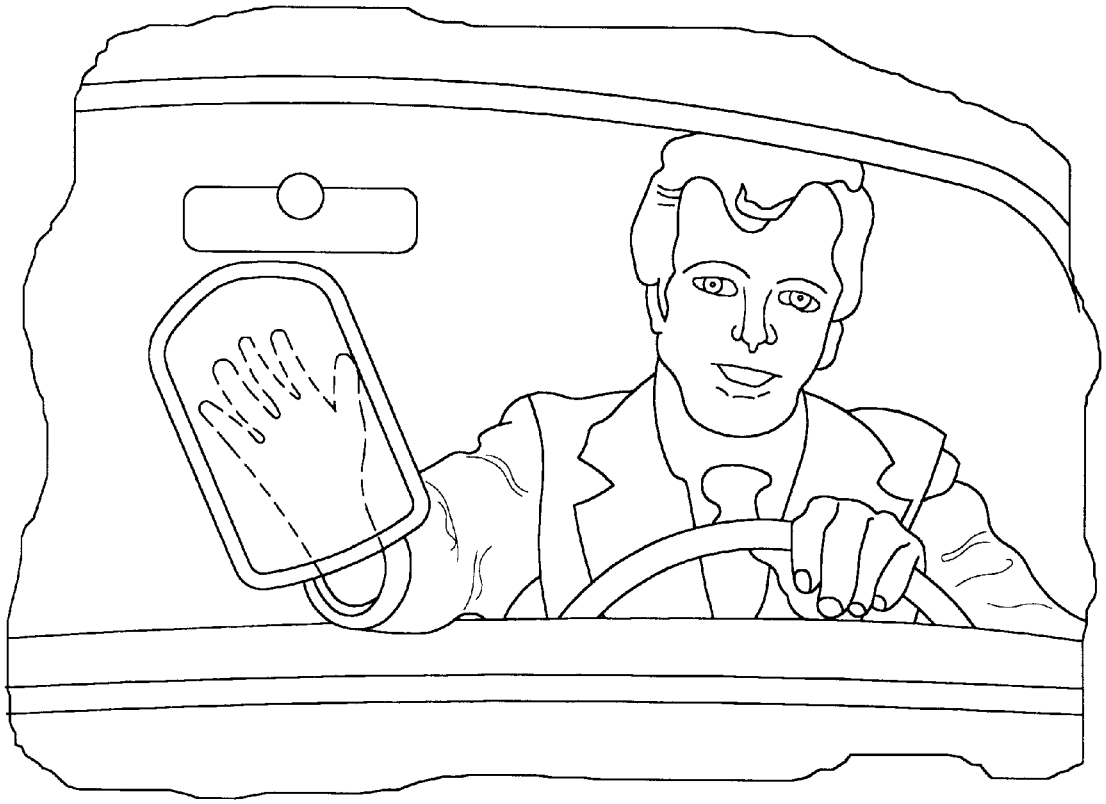
FIG. 8 is a perspective view showing the cleaning and drying mitt in use.

As shown in drawing FIGS. 1–8, the present invention includes disposable cleaning and drying mitt and packaging system 1 including flexible mitt 2 having an inner pouch 3, with open compartment 3*a* formed therein, which is proportioned for receiving the hand of a user. Open hand compartment 3*a* includes open proximal end 3*b* through which an access passage opens into hand compartment 3*a*. Mitt 2 also includes distal end 3*c* which is located at the other end of mitt 2 from proximal end 3*b* thereof. Open compartment 3*a* of pouch 3 has optional handle 4, such as a pull ribbon, extending therein for finger-grasp pulling of mitt 2 inside out.

Mitt 2 also has a pair of opposite upper and lower cover faces 5, 6 and generally flat moisture-proof perimeter 7. Moisture proof perimeter 7 extends outward from the pair of cover faces 5, 6 and is in coextensive contact with each respective cover face 5, 6. Together, cover faces 5,6 enclose hollow pouch 3 in a moisture proof and leak proof environment. Perimeter 7 is a leak-proof moisture barrier between respective cover faces 5, 6.

While cover faces 5,6 are preferably two separate members, in an alternate embodiment they may comprise at least one cover face (not shown) enclosing both sides of pouch 3.

Cover faces 5, 6 enclose the upper and lower outer work surfaces of pouch 3 of mitt 2, such as respectively inner wetting layer 8 and drying layer 9. For example, wetting layer 8 has a wetting pad 8*a* mounted thereon. Wetting pad 8*a* is sized smaller than the area of wetting layer 8. Wetting pad 8*a* is preferably pre-soaked with a cleaning fluid for wipe-on application to a surface to be cleaned. Furthermore, drying layer 9 has a drying pad 9*a* mounted thereon and drying pad 9*a* is sized smaller than the area of drying layer 9.

Outer cover faces 5, 6 are releasably secured to pouched 3 to form mitt 2.

For separate cleaning and drying sections, pouch 3 includes a pair of separate hollow moisture-sealed compartments 5*a*, 6*a*. Compartments 5*a*, 6*a* respectively are arranged to include respective wetting and drying layers 8, 9 to form separate respective moisture proof enclosures about respective wetting and drying pads 8*a*, 9*a*.

Separate moisture-sealed compartments 5*a*, 6*a* of pouch 3 have means for individually releasably securing separate outer cover faces 5, 6 to respective wetting and drying layers 8, 9 of mitt 2. Such means include outer cover layers 5, 6 being individual user-removable peel off covers with graspable tab ends 5*b*, 6*b*.

Preferably, mitt 2, its flat moisture-proof perimeter 7 and layers 8, 9 of open pouch 3 are made of a heat-sealable thermoplastic polymer. Each outer layers 5 and 6 is preferably made of a 1.8–2.0 mil co-extrusion of aluminized MYLAR, polyester film-polyethylene laminated film having respective lower polyethylene layers 5*c*, 6*c* thermally bonded to wetting and drying layers 8, 9 of mitt 2, which layers 8, 9 are made preferably of a polymer, such as polyethylene or polypropylene.

If polyethylene is used for layers 8, 9 of pouch 3 of mitt 2, each layer 8, 9 is about a 5 mil polyethylene film and the polyester film for pouch 3 is a co-extruded aluminized polyester film polyethylene film of a thickness from about 1.8 to 2.0 mils.

Perimeter 7 is releasably thermally bonded to inner polyethylene layers 5*c*, 6*c* of the co-extruded aluminized polyester film polyethylene film layers 5, 6.

Structurally, disposable cleaning and drying mitt 2 is shaped and sized to accommodate the hand of a user, and its shape may be rectangular, oval or round.

It is further noted that other modifications may be made to the present invention, without departing from the scope of the invention, as noted in the appended claims. For example, pouch 3 of mitt 2 can be made of any thermoplastic polymer which can be heat sealed, to form a leak-proof barrier having a peel-off layer which will easily be pulled off of pouch 3 of mitt 2, without ripping pouch 3 of mitt 2.

We claim:

1. A prepackaged cleaning mitt comprising:

a mitt having a first side and a second side, said mitt defining an interior configured and dimensioned to receive a hand of a user, said first side having a dry absorbent material adhered thereto, said second side having a carrier supporting a cleaning material independent of said dry absorbent material on said first side; and a removable seal cover attached adjacent a perimeter of said mitt on said second side to protect said carrier supporting said cleaning material from contamination.

2. A prepackaged cleaning mitt as in claim 1, further comprising a removable seal cover attached adjacent a perimeter of said mitt on said first side to protect said dry absorbent material from contamination.

3. A prepackaged cleaning mitt as in claim 2, wherein at least one of the removable seal covers is formed of a moisture impervious material.

4. A prepackaged cleaning mitt as in claim 3, wherein the moisture impervious material comprises aluminized polyester/polyethylene laminate film.

5. A prepackaged cleaning mitt as in claim 2, wherein said seal covers fold back and remain attached to said mitt to protect a portion of an arm of a user.

6. A prepackaged cleaning mitt as in claim 1, wherein the mitt is formed of a heat-sealable thermoplastic polymer.

7. A prepackaged cleaning mitt as in claim 6, wherein said first and second sides of said mitt are heat-sealed about a portion of their periphery to define said interior.

8. A prepackaged cleaning mitt as in claim 6, wherein the heat-sealable thermoplastic polymer is selected from the group consisting of polypropylene and polyethylene.

9. A prepackaged cleaning mitt as in claim 1, wherein the cleaning material is a liquid.

10. A prepackaged cleaning mitt as in claim 1, wherein the cleaning material is selected from the group consisting of window cleaning, polishing, dusting, buffing and skin application materials.

11. A prepackaged cleaning mitt as in claim 1, wherein said interior of said mitt is sealed adjacent a periphery of said first and second sides.

12. A prepackaged cleaning mitt as in claim 1, wherein said removable seal cover is attached onto said mitt.

13. A prepackaged cleaning mitt as in claim 1, wherein said carrier supporting said cleaning material is sealed independent from said dry absorbent material.

14. A prepackaged cleaning mitt comprising:

a mitt having a first side and a second side, said mitt defining an interior configured and dimensioned to receive a hand of a user, said first side having an absorbent material positioned therein, said second side having a cleaning material positioned thereon independent from said absorbent material;

a removable seal cover independently sealing said cleaning material positioned on said second side of said mitt; and a removable cover independently protecting said absorbent material positioned on said first side of said mitt.

15. A prepackaged cleaning mitt as in claim 14, wherein said first and second sides are formed of a heat-sealable material and are heat-sealed together to define said interior.

16. A prepackaged cleaning mitt as in claim 14, wherein said cleaning material on said second side is liquid absorbed in a carrier and said removable seal cover hermetically seals said liquid absorbed in the carrier from ambient conditions.

17. A prepackaged cleaning mitt as in claim 16, wherein at least one of said removable seal cover and said removable cover is formed of aluminized polyester/polyethylene laminate film.

18. A prepackaged cleaning mitt as in claim 17, wherein said removable seal cover, said removable cover, said first side and said second side are heat-sealed adjacent at least a portion of their periphery to define said interior.

19. A prepackaged cleaning mitt as in claim 14, wherein said seal covers fold back and remain attached to said mitt to protect a portion of an arm of a user.

20. A prepackaged cleaning mitt as in claim 14, wherein the cleaning material is selected from the group consisting of window cleaning, polishing, dusting, buffing and skin application materials.

21. A prepackaged cleaning mitt as in claim 14, further comprising an absorbent material impregnated with a liquid cleaning material.

22. A prepackaged cleaning mitt as in claim 14, further comprising a pull ribbon positioned within said interior and configured to invert said mitt in a position to bring said first and second sides into juxtaposition for disposal.

23. A prepackaged cleaning mitt as in claim 14, further comprising tab ends formed integral with said removable seal cover and said removable cover to facilitate removal thereof.

24. A prepackaged cleaning mitt comprising:

a first side formed of a heat-sealable material heat-sealed to a second side formed of heat-sealable material, said first and second sides defining a moisture impervious interior along said heat seal and configured and dimensioned to receive a hand of a user, said first side having an independent absorbent material bonded thereto, said second side having an independent absorbent material impregnated with a fluid cleaning material bonded thereto;

a removable seal cover heat-sealed to said mitt over said independent absorbent material impregnated with a fluid cleaning material; and a removable cover heat-sealed to said mitt over said independent absorbent material bonded to said first side.

25. A prepackaged cleaning mitt as in claim 24, wherein said first and second sides are formed of a heat-sealable material selected from the group consisting of polyethylene and polypropylene.

26. A prepackaged cleaning mitt as in claim 25, wherein said removable seal cover and said removable cover are formed of an aluminized polyester/polyethylene laminate film.

* * * * *